US005106577A

United States Patent [19]

Fesler

[11] Patent Number: 5,106,577

[45] Date of Patent: Apr. 21, 1992

[54] CEMENT COOLER GRATE ALLOY

[75] Inventor: Dennis J. Fesler, St. Louis, Mo.

[73] Assignee: Carondelet Foundry Company, St. Louis, Mo.

[21] Appl. No.: 656,303

[22] Filed: Feb. 14, 1991

[51] Int. Cl.[5] ..... C22C 38/44; C22C 38/52

[52] U.S. Cl. ..... 420/12; 420/38

[58] Field of Search ..... 420/12, 38

[56] References Cited

FOREIGN PATENT DOCUMENTS 57-73170 5/1982 Japan ..... 420/12

*Primary Examiner*—Deborah Yee

*Attorney, Agent, or Firm*—Senniger, Powers, Leavitt & Roedel

[57] ABSTRACT

Heat resistant alloys which have excellent abrasion resistance in the 1200° to 1400° F. (650° to 760° C.) temperature range and good resistance to hot gas corrosion resistance to about 1600° F. (870° c.), consisting essentially of:

| | |
|---|---|
| CHROMIUM | 11-20% BY WEIGHT |
| NICKEL | 3-10.5% |
| MOLYBDENUM | 1-4% |
| ALUMINUM | 0.25%-1.5% |
| CARBON | 2-4.5% |
| NITROGEN | UP TO 0.25% |
| SILICON | UP TO 2.5% |
| COPPER | UP TO 4% |
| COBALT | UP TO 4% |
| MANGANESE | UP TO 4% |
| COPPER + COBALT | UP TO 4% TOTAL |
| COPPER + COBALT + MANGANESE | UP TO 5% TOTAL |
| IRON & IMPURITIES BALANCE | ESSENTIALLY |
| provided that NICKEL + COPPER + COBALT is | 6 TO 11.5% |
| and further provided that NICKEL + COPPER + COBALT + MANGANESE is | 6 TO 12.5% |

10 Claims, No Drawings

CEMENT COOLER GRATE ALLOY

FIELD OF THE INVENTION

This invention relates to low cost heat and abrasion resistant alloys suitable for use in the manufacture of structural parts for industrial furnaces and like installations where such parts must possess high temperature hardness and resistance to hot corrosive gases. The alloys can be air melted and cast.

BACKGROUND OF THE INVENTION

Steels and alloys intended for high temperature service typically are also subjected to one or more other adverse factors. Thus, each application of such alloys often dictates resistance to two or more of such factors as impact, static or cyclical stresses, thermal shock, thermal fatigue, warping, carburization, corrosion by hot gases, or other substances, and abrasion. Lowest effective cost is also always a very important factor.

For example, portland cement is made from a mixture of limestone, clay, cement rock, or slag, which gives approximately the following composition: 63% calcium oxide, 23% silica, 8% alumina, and the balance small amounts of oxides of iron, magnesium, sulfur, sodium and potassium. The limestone, which is mainly calcium carbonate, and the other substances are heated in a refractory lined rotary kiln to temperatures as high as about 3000° F. (1650° C.). Carbon dioxide is driven out of the carbonate by the intense heat, leaving mainly calcium oxide in a sticky mass of silica and other oxides called clinker. The hot clinker is dumped out of the kiln at about 2500° F. (1370° C.) onto a traveling series of cement cooler grates, usually with a recycled layer of cool, crushed clinker between the grates and the fresh hot clinker. The grates themselves may reach temperatures in some operations as high as 1500° F. to 1600° F. (815° C. to 870° C.) but most likely operate at about 1200° to 1400° (650° C. to 760° C.). Cooling air is passed upwardly through the clinker bed, carrying the hot corrosive gases with it. The grates are thus subjected to the very abrasive clinker and the heat from the clinker due to conduction and radiation effects. Impact and other stresses are not severe.

Enormous tonnages of alloys for the manufacture of these grates are employed around the world, and they must be of relatively low cost. Therefore, nickel-base and cobalt-base superalloys and other exotic alloys are far too expensive for this application. On the other hand, several standard heat resistant alloy types, such as the standard stainless steels and heat resistant alloys of the Alloy Castings Institute Division of the Steel Founders Society of America, have been employed in this application. However, with their usual carbon contents of about 0.40% to 0.75%, those alloys only have a room temperature hardness of around 200 Brinell Hardness Number (BHN) which is lowered to about 80 to 110 BHN at 1300° F. (700° C.), an average working temperature for cement cooling grates. Thus, when the carbon content of process returns or of recycled stainless steel scrap climbs too high, the scrap must either be repurified by a very expensive process to once again reduce carbon, or the too-high-carbon stainless steel may be recycled in nickel-chromium heat resistant alloys which allow much higher carbon contents. As a result, types CF8M, 316, 316L, 317, 317L and similar stainless steels must either undergo expensive repurification to remove carbon or be employed in some new manner. Furthermore, most of the heat resistant alloys specify a maximum of 0.5% Mo. The use of process returns and recycled scrap from cast or wrought molybdenum-containing stainless steels, which contain from 2% to 4% Mo, presents an additional problem.

Hardness values of various substances are obtained by pressing various types of indenter into their surfaces under standardized loads. However, in the case of all but the simplest solid solution metallic alloys, because the penetration of the indenter is resisted by one or more microscopically small hard particles imbedded in the alloy matrix, the effect of the indenter is to give a sort of average value for the various microscopic grains and particles of different hardnesses encountered under the relatively large area of the indenter. Nonetheless, the derived hardness measurements are found to be quite useful in evaluating properties of metallic alloys.

Hardnesses of the different types of alloy matrices as well as those of various secondary particles and phases not only vary considerably between themselves at room temperature but also possess different rates of softening, coalescing or even disappearing, with increasing temperature. In general, the higher hardness of the additional phases in metallic alloys as well as greater volume fractions of those phases at operating temperatures have pronounced effect in increasing the hot hardness and abrasion resistance of alloys. Contrariwise, factors that increase alloy matrix hardness generally have much less direct effect upon hot hardness and hot wear resistance of an alloy. However, such factors may have the indirect effect of reducing solubility, coalescence or transformation of the harder phases at operating temperatures.

Factors that increase the hot strength of alloys also increase hot hardness. On the other hand, factors that primarily increase hot hardness often reduce hot strength considerably. Hot strength is basically a tensile property, while hot hardness and abrasion resistance are compressive properties.

It is very difficult to formulate in bulk the various secondary phases common to the alloys of interest in order to determine the true hardness values of the phases themselves. However, reasonable estimates of alloy hardness values can be made. For example, the hardness values given in Table I below were taken primarily from "Temperature Dependence of the Hardness of Secondary Phases Common in Turbine Bucket Alloys," J. H. Westbrook, pp. 898–904, *Journal of Metals*. July 1957, *Transactions* of the American Institute of Metallurgical Engineering. An additional source of information and verification is *Tverdost' Spravochnik*. A. A. Ivan'ko, Akademiya Nauk Ukrainskoi SSR, Institute Problem Materialovedeniya, Naukova Dumka, Kiev, 1968. (*Hardness Reference Book*, A. A. Ivan'ko Academy of Sciences of the Ukrainian SSR, Institute of Materials Science, Science Press, Kiev, 1968.)

The hot hardnesses in Westbrook's work were obtained by special equipment employing a modified Vickers hardness tester with diamond indenter and are reported as the Vickers Hardness Number (VHN). The Vickers hardness of a substance is very close to the Brinell hardness of that substance.

TABLE I

| SUBSTANCE | VICKERS HARDNESS NUMBER AT ROOM TEMPERATURE | AT 1300° F. (700° C.) |
|---|---|---|
| ALUMINUM OXIDE | 2085 | 1700 |
| IRON-MOLYBDENUM | 1350 | 1150 |
| ALUMINUM NITRIDE | 1230 | 1070 |
| CHROMIUM CARBIDE | 1000 | 830 |
| IRON-MOLYBDENUM-CHROMIUM SIGMA PHASE | 1070 | 800 |
| IRON-CHROMIUM SIGMA PHASE | 1150 | 680 |
| IRON CARBIDE | 565 | 400 |
| NICKEL TITANIUM GAMMA PRIME | 500 | 275 |
| NICKEL ALUMINUM GAMMA PRIME | 300 | 240 |
| MARTENSITIC 410 STAINLESS STEEL | 130 | 50 |
| AUSTENITEC 316 STAINLESS STEEL | | 130 |

The microstructure of nickel-base superalloys consists of an austenitic, or face-centered-cubic (FCC), solid-solution matrix, very small amounts of carbides, and the coherant intermetallic phase known as gamma prime. Gamma prime precipitates are FCC compounds of the $A_3B$ type, in which the A atoms are mainly nickel, while the B atoms are mainly aluminum and titanium. These alloys usually contain about 1% to 6% Ti, and their matrices remain fully austenitic. These alloys derive their hot strength and hot hardness from the gamma prime phase.

From Table I it is evident that at both room temperature and the average cooler grate operating temperature of 1300° F. (700° C.), titanium-rich gamma prime is harder than aluminum-rich gamma prime but that neither is as hard at either temperature as any of the other hardening components.

Also shown in Table I are the hardness values of the low-carbon 12% Cr type 410 martensitic stainless steel and of low-carbon 18% Cr-8% Ni-2.5% Mo 316 type austenitic stainless steel. These two examples indicate the very low hot hardness values of both matrix types in the absence of hardening components.

Nickel-base and cobalt-base superalloys are hardened to some extent by large quantities of such solid-solution hardening elements as tungsten, molybdenum, columbium (niobium) and tantalum, but the former derives its main strengthening and hardening from the finely-dispersed gamma prime particles while the latter derives these properties mainly by finely dispersed complex-carbide particles.

Representative examples of prior art which describe alloys said to possess primarily high temperature strength and corrosion resistance include the following patents.

Anger, U.S. Pat. No. 2,857,266, teaches the use of molybdenum and low carbon and aluminum contents in alloys of relatively high nickel and chromium content to improve hot strength and corrosion resistance to about 2300° F. (1260° C.). These alloys depend upon a stable FCC matrix structure for hot strength and have hot hardnesses very close to those of the standard HK type alloys.

Eiselstein et al, U.S. Pat. No. 3,930,904, discloses alloys containing 0.05% to 0.5% Al and 5% to 7% Mo in low-carbon 40% Ni and 15% Cr alloys. The very high nickel content offsets the sigma-forming tendency of the molybdenum and aluminum, and minor quantities of carbides are formed. Such alloys have relatively low hardnesses at all temperatures.

Goda et al, U.S. Pat. No. 3,811,875, teaches 0.25% to 2% Al and up to 3.5% Mo additions in low-carbon austenitic stainless steels. Their room temperature hardness (Table I) ranges from 78 to 86 Rockwell B, which is equivalent to about 140 to 166 BHN, respectively. Their hardness at 1300° F. (700° C.) would therefore be expected to be about 90 to 100 BHN.

Yamaguchi et al, U.S. Pat. No. 4,141,762, teaches 0.06% to 6% Al and up to 6% Mo in low-carbon duplex alloys of mixed FCC-BCC matrix structures said to have remarkably excellent hot workability. The alloys are formulated to be of high ductility and low hardness, as contrasted to high hardness and no significant hot workability.

Wick, U.S. Pat. No. 3,167,424, teaches alloys for valve seat insert castings of 0.85% to 3.50% C., 1.5% to 3.5% Si, 0.5% to 3% Mn, 4% to 12% Mo, 4% to 12% Co, 4% to 12% W, 0.2% to 6% Cu, 0.2% to 4% Al, 5% to 35% Fe, 5% to 20% Cr and the remainder Ni. The preferred composition is 2.5% C, 2.5% Si, 1% Mn, 40% Ni, 10% Cr, 7% Mo, 7% Co, 7% W, 1.5% Cu, 1.5% Al and 20% Fe. While such alloys might have reasonably good hot hardness at 1300° F. they are entirely beyond the cost range of cement cooler grate castings due to their nickel, cobalt, tungsten and molybdenum contents.

In spite of these prior art efforts, there remains a need for low cost alloys having good high temperature hardness and resistance to hot corrosion gases.

SUMMARY OF THE INVENTION

It is therefore an object of this invention to provide heat resistant alloys which have excellent abrasion resistance in the 1200° F. to 1400° F. (650° to 760° C.) temperature range and good resistance to hot gas corrosion resistance to about 1600° F. (870° C.). It is a further object of the invention to provide such alloys that are air meltable and castable and of relatively very low cost for heat resistant alloys. It is a further object of the invention that such alloys be very tolerant of such tramp elements and impurities as may be encountered in formulating them from various impure scraps and foundry returns.

It is also an object of the invention to provide alloys which may employ in their formulation scraps and returns of molydenum-containing stainless steels whose carbon contents exceed the respective specification ranges for said alloys. It is a further object of the invention that such alloys have a relatively very low critical or strategic element content.

It is an object of the present invention to provide alloys having high resistance to abrasion and hot gas corrosion at low cost. A further object of the invention is to provide alloys which are somewhat tougher at operating temperatures than at room temperature.

While the primary object of the invention is to fill the need for greatly improved but lower cost cement cooler grates and similar parts requiring superior resistance to hot abrasion and hot gas corrosion, it is an important object of this invention to provide molybdenum-containing alloys which can be economically recycled.

According to this invention alloys are provided which consist essentially of:

| | |
|---|---|
| CHROMIUM | 11-20% BY WEIGHT |

-continued

| | |
|---|---|
| NICKEL | 3-10.5% |
| MOLYBDENUM | 1-4% |
| ALUMINUM | 0.25%-1.5% |
| CARBON | 2-4.5% |
| NITROGEN | UP TO 0.25% |
| SILICON | UP TO 2.5% |
| COPPER | UP TO 4% |
| COBALT | UP TO 4% |
| MANGANESE | UP TO 4% |
| COPPER + COBALT | UP TO 4% TOTAL |
| COPPER + COBALT + MANGANESE | UP TO 5% TOTAL |
| IRON & IMPURITIES BALANCE | ESSENTIALLY |
| provided that NICKEL + COPPER + COBALT is | 6 TO 11.5% |
| and further provided that NICKEL + COPPER + COBALT + MANGANESE is | 6 TO 12.5% |

DETAILED DESCRIPTION OF THE INVENTION

As discussed above, the present invention is directed to relatively low cost heat and abrasion resistant alloys suitable for castings for cement cooler grates and similar industrial installations such as furnaces.

The components of the alloys of the inventions are:

When nickel-bearing scraps or other recyclable sources are plentiful, the following ranges of proportions of the components are particularly advantageous:

| | |
|---|---|
| CHROMIUM | 11-18% |
| NICKEL | 6-10.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 1.5% |
| IRON | ESSENTIALLY BALANCE |

When cobalt-bearing scraps are economically available and it is desirable to gain benefit from small amounts of cobalt present in the melt, the following ranges of proportions of the components may be readily employed without detriment to the alloys of the invention.

| | |
|---|---|
| CHROMIUM | 13-18% BY WEIGHT |
| NICKEL | 3-10.5% |
| COBALT | UP TO 4% |
| NICKEL + COBALT | 6-11.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 1.5% |
| IRON | ESSENTIALLY BALANCE |

When nickel-bearing scraps are in limited supply and it is desirable to minimize nickel consumption, lower cost copper may be substituted for a portion of the nickel according to the following ranges of proportions of the components:

| | |
|---|---|
| CHROMIUM | 13-18% BY WEIGHT |
| NICKEL | 3-10.5% |

-continued

| | |
|---|---|
| COPPER | UP TO 4% |
| NICKEL + COPPER | 6-11.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 1.5% |
| IRON | ESSENTIALLY BALANCE |

When low-cobalt scrap is available, but it remains desirable to employ less nickel, a combination of copper plus cobalt may be substituted for a portion of the nickel content according to the following ranges of proportions of the components:

| | |
|---|---|
| CHROMIUM | 13-18% BY WEIGHT |
| NICKEL | 3-10.5% |
| COBALT | LESS THAN 4% |
| COPPER | LESS THAN 4% |
| COBALT + COPPER | UP TO 4% |
| NICKEL + COBALT + COPPER | 6-11.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 1.5% |
| IRON | ESSENTIALLY BALANCE |

When it is desirable to employ the lowest contents of nickel, cobalt and copper for such reasons as cost or limited supply, the following ranges of proportions of the components of the invention may be advantageously employed:

| | |
|---|---|
| CHROMIUM | 13-18% BY WEIGHT |
| NICKEL | 3-10.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 4% |
| NICKEL + MANGANESE | 7-12.5% |
| IRON | ESSENTIALLY BALANCE |

When various sources of scraps are available and it is desirable to employ cobalt, copper and manganese all together to minimize the required nickel content, the following ranges of proportions of the components of the invention may be employed:

| | |
|---|---|
| CHROMIUM | 13-18% BY WEIGHT |
| NICKEL | 3-10.5% |
| COBALT | LESS THAN 4% |
| COPPER | LESS THAN 4% |
| MANGANESE | UP TO 4% |
| MOLYBDENUM | 2 TO 4% |
| NICKEL + COPPER + COBALT | 6-11.5% |
| NICKEL + COPPER + COBALT + MANGANESE | 6-12.5% |
| CARBON | 3-4% |
| NITROGEN | UP TO 0.25% |
| SILICON | UP TO 1.5% |
| IRON | ESSENTIALLY BALANCE |

The alloys of the invention contain at least 11% Cr, and preferably at least 13% Cr in order to maintain adequate scaling resistance in the presence of hot corrosive gasses as well as contributing to the formation of sigma phase, which provides high temperature hardness, and complex carbides. Chromium contents greater than about 18% would increase the required nickel contents and therefore unnecessarily increase the costs of the alloys of the invention.

The nickel contents of the alloys of the invention are chosen to provide the proper metallurgical structures in juxtaposition with the amount of chromium present. The desired nickel content may be somewhat reduced by the presence of up to about 4% of the total of copper plus cobalt and up to about 5% of the total of copper plus cobalt plus manganese, where the amount of manganese does not exceed 4%.

While manganese behaves somewhat like nickel in alloys of the invention, up to about 5% Mn by weight may be ignored insofar as its structural effect is concerned. Beyond about 1% Mn further increases in manganese content must be regarded as equivalent to nickel, so that no more than a total of 12.5% Ni+Co+Cu+Mn may be present, with a maximum of 11.5% Ni+Co+Cu. Greater than about 4% Mn causes excessive burn on or fusion of sand mold materials in ordinary air melting and typical foundry molding practice. This is due to the fact that greater than about 4% Mn in the molten metal at high temperature results in the formation of some manganese dioxide on the surface of the metal. Manganese dioxide is chemically a basic substance at high temperature and reacts with typical substances present which are acidic at those temperatures, such as silicon dioxide or silicates of he usual molding, furnace lining and pouring ladle refactories. The result of these reactions may be surface pinhole or bubble voids in the final solid castings as well as a very adherent scale which is difficult and costly to remove.

Copper also behaves somewhat like nickel in alloys of the invention in its effect upon matrix structure. However, greater than about 4% Cu content results in precipitation of copper-rich particles in the final solid casting. This effect is employed to strengthen precipitation hardened stainless steels, which are to be employed at or near room temperature. However, at high temperatures these copper-rich particles tend to seriously reduce the hot strength of the alloys of the invention.

It is possible to employ up to about 4% Co as a partial substitute for nickel in alloys of the invention. Larger amounts may upset the metallurgical balance of the alloys and surely increase costs unnecessarily.

While silicon may be present in alloys of the invention in amounts up to about 2.5% without seriously embrittling them, it is preferable to limit silicon to about 1.5% maximum.

Nitrogen enhances the alloys of the invention through the formation of the very hard aluminum nitride particles. While these nitrides are themselves solids, greater than about 0.25% N content in alloys of the invention results in gas hole defects in the final solid casting.

Molybdenum forms complex carbides as well as molybdenum-bearing sigma phase. Both of these components increase room temperature and high temperature hardnesses well beyond those of molybdenum-free alloys. While a molybdenum content up to about 8% may be tolerated in high carbon alloys intended for hot abrasion service, molybdenum is a moderately scarce and expensive component. It has been found that in alloys of the invention about 2% to 4% Mo content provides excellent hot hardness without causing excessive brittleness.

Aluminum is a very strong sigma-phase promoting element. It is also a very powerful deoxidizer and, as such, tends, to form finely dispersed particles of aluminum oxide in alloys of the invention. Therefore aluminum is a very important agent for developing oxides, nitrides and sigma phase in alloys of the present invention, as contrasted to its use in promoting gamma prime in certain other alloys. In addition to its hardening effects, even these small amounts of aluminum enhance scale resistance of the alloys of the invention to hot corrosive gases. It has been found desirable to limit aluminum content to about 1.5%, preferably to about 1.2%, maximum, because larger levels of aluminum in the air-melted alloys of the invention may result in excessive brittleness as well as laps and seams defects in the solid metal castings due to the so-called scum defect.

In alloys of the present invention, the low nickel levels are not sufficient to maintain a completely FCC structure. With the addition of molybdenum and aluminum, however, both of which tend to form the very hard sigma phase structures, that problem is overcome. In alloys of the invention, molybdenum also forms complex carbides which are much harder than the chromium carbides such as found in 16-6 type alloys.

Aside from destabilizing the FCC matrix in alloys of the invention, aluminum also forms very hard oxide and nitride particles, both of which contribute to increased hot hardness. At the higher nickel levels of type 316 stainless steel, the molybdenum content alone does not tend to form sigma phase. On the other hand, in alloys of the invention approximately the same molybdenum content coupled with the aluminum and low nickels contents have a strong tendency to form sigma phase particles which strongly augment the carbides in producing high hot hardness.

Carbon levels of alloys of the invention should be at least 2% minimum and preferably about 3% minimum in order to provide the desired hot hardness. Carbon should not exceed about 4.5% in any case and preferably should not exceed about 4% due to the embrittling effect of higher quantities of massive carbides in the microstructure of the alloys when higher levels of carbon are employed.

Alloys of the present invention also fill another very important need. Carbon is the major problem in stainless steel production. Stainless steels are made to 0.08% or 0.03% maximum carbon contents. In the manufacture of stainless steel castings, removal of risers, gates and fins, as well as other production factors, contaminate the metal returns, so the carbon content climbs. Therefore, there has remained a need for useful alloys employed in large tonnages that can be made from the molybdenum-bearing and/or high carbon stainless steels.

To illustrate the outstanding hardness of the alloys of the invention the range of hardness values of representative examples of those alloys and various prior art alloys were compared. The compositions of the prior art alloys compared are set forth in Table II, below. Alloy 718 is a typical nickel-base alloy, X-40 is an example of a cobalt-base alloy, and S-816 is an example of a nickel-cobalt-base alloy. The hardness values are set forth in Table III, below, and are reported on the Brinell Hardness Number (BHN) scale. A Brinell hardness tester was used to obtain room temperature hardnesses for alloys of the invention. However, since the 10 mm diameter ball indenter of the Brinell tester isn't very suitable for measuring hot hardness the hot hardness values for alloys of the invention were obtained with a Rockwell hardness tester employing a diamond indenter. The hardness values so obtained were then converted to BHN values by employing the standard hardness conversion tables. Hardness values in Table III for the comparative prior art alloys were taken from various published literature sources including manufacturer supplied information. In some instances hardnesses were given as Rockwell C, Rockwell B, Rockwell A or Vickers values. In all instances such data were converted to BHN values using standard conversion tables. From these hardnesses it may be seen that the relatively very expensive superalloys (718, X-40 and S-816) based upon nickel or cobalt offer no hot hardness advantage at 1300° F. (700° C.) compared to alloys of the invention despite their tauted superior hot strengths.

TABLE II

| CHEMICAL COMPOSITION, WEIGHT PERCENT | | | | | | | |
|---|---|---|---|---|---|---|---|
| ALLOY | Ni | Cr | Mo | Al | Co | C | OTHERS |
| 718 | 52% | 19% | 3% | .6% | — | .04% | 1% Ti, 5% Cb, 18.5% Fe |
| X-40 | 11% | 25% | — | — | 54% | .50% | 7.5% W |
| S-816 | 20% | 20% | 4% | — | 46% | .40% | 4% W, 4% Cb, 3% Fe |
| STEL-LITE 6 | — | 33% | — | — | 55% | 1.25% | 4% Fe, 6% W |
| STAR J | — | 33% | — | — | 45% | 2.50% | 1% Fe, 18 W |
| 18-4-1 | — | 4% | .7% | — | — | .75% | 18% W, 1% V, 75% Fe |
| HK .35% C | 20% | 25% | — | — | — | .35% | 53% Fe |
| HK .45% C | 20% | 25% | — | — | — | .45% | 53% Fe |
| HK 2.4% C | 20% | 25% | — | — | — | 2.40% | 51% Fe |
| 440C | — | 17% | — | — | — | 1.00% | 81% Fe |
| H-II | — | 5% | 1.4% | — | — | .40% | .4% V, 91% Fe |
| HC 16-6 | 6% | 16% | — | — | — | 4.00% | 72% Fe |

TABLE III

| BRINELL HARDNESS NUMBER | | |
|---|---|---|
| ALLOY | AT ROOM TEMPERATURE | AT 1300° F. (700° C.) |
| ALLOYS OF THE INVENTION (See Table V for compositions) | 400–500 | 230—270 |
| NICKEL-BASE 718 | 330 | 195 |
| COBALT-BASE X-40 | 330 | 200 |
| NICKEL-COBALT BASE S-816 | 300 | 190 |
| STELLITE 6 | 416 | 215 |
| STAR J | 620 | 400 |
| 18-4-1 HIGH SPEED TOOL STEEL | 710 | 180 |
| HK .35% C | 175 | 84 |
| HK .45% C | 190 | 93 |
| HK 2.4% C | 290 | 150 |
| 440C % C | 630 | 70 |
| H-II HOT WORK TOOL STEEL | 555 | 130 |
| HC 16-6 | 495 | 190 |

While retaining useful hardness at 1300° F. (700° C.), the 18-4-1 alloy and similar grades of high speed tool steels are not suitable for cooler grater applications for at least two reasons. First of all, their low chromium and high tungsten and vanadium contents combine to cause them to deteriorate rapidly in hot gases at 1300° F. (700° C.). In addition, they are not suitable for making castings because their high tungsten contents cause marked element segregation and coring or dendritic structure during their very long freezing ranges. Ingots of such alloys must, therefore, undergo a great deal of forging and reheating to refine their structures.

The cobalt-base Star J alloy and similar high-carbon cobalt-base alloys have the same structure problems as the 18-4-1 alloy and other high speed tool alloys due to their high tungsten levels, aside from their excessively high costs. When alloys having lower tungsten levels are employed, as in Stellite 6 alloy, their 1300° F. (700° C.) hardness levels drop, while their costs are not much reduced.

The following examples further illustrate the invention.

EXAMPLE 1

One hundred pound heats of several different alloys not of the invention were air melted in a high frequency induction furnace. Chemical analyses and room temperature hardness of these alloys are set forth in Table IV. Iron and impurities made up the balance.

TABLE IV

| ALLOY | C | SI | NI | CR | MO | MN | CU | AL | BHN |
|---|---|---|---|---|---|---|---|---|---|
| 1 | 2.83 | 1.79 | 17.96 | 2.82 | — | 1.42 | — | — | 150 |
| 2 | 2.81 | 1.76 | 18.02 | 6.07 | — | 1.07 | — | — | 252 |
| 3 | 2.80 | 1.81 | 15.11 | 16.11 | — | 1.32 | — | — | 390 |
| 4 | 3.82 | 4.53 | 10.07 | 17.03 | — | 1.21 | — | — | 650 |
| 5 | 1.02 | 1.22 | 8.13 | 18.17 | — | 1.18 | — | — | 220 |
| 6 | 2.53 | 1.11 | 8.26 | 18.08 | — | 1.09 | — | — | 370 |
| 7 | 3.51 | 1.17 | 8.08 | 18.13 | — | 1.11 | — | — | 390 |
| 8 | 2.23 | 5.51 | 30.12 | 5.21 | — | 0.22 | — | — | 240 |
| 1558 | 0.10 | 7.80 | 15.97 | 13.02 | — | 0.58 | 2.30 | — | 235 |
| 9 | 3.51 | 7.82 | 10.03 | 16.63 | — | 0.61 | 2.32 | — | 670 |
| 10 | 1.52 | 1.22 | 10.11 | 17.26 | 3.13 | 1.22 | — | — | 290 |
| 24 | 3.70 | 1.84 | 6.06 | 15.08 | 1.40 | 1.10 | — | — | 360 |
| 12 | 2.53 | 0.81 | 10.10 | 17.11 | 3.06 | 0.65 | — | — | 444 |
| 13 | 3.49 | 1.42 | 10.08 | 17.09 | 2.85 | 0.56 | — | — | 460 |
| 14 | 2.57 | 0.77 | — | — | — | 0.71 | — | 8.75 | 442 |
| 15 | 2.55 | 0.91 | — | — | — | 0.74 | — | 5.55 | 325 |
| 16 | 2.55 | 1.10 | — | — | — | 0.77 | — | 2.66 | 275 |
| 17 | 2.65 | 1.12 | — | — | — | 0.74 | — | 1.17 | 240 |
| 18 | 2.62 | 1.10 | 7.03 | 17.15 | — | 0.88 | — | 1.15 | 365 |
| 19 | 3.53 | 1.19 | — | 17.21 | — | 0.85 | — | 5.55 | 540 |
| 20 | 2.04 | 5.49 | 4.85 | 6.18 | — | 4.70 | 3.75 | — | 512 |
| 21 | 3.13 | 3.71 | 4.90 | 8.26 | — | 4.50 | 3.93 | — | 364 |

Based upon my industrial foundry production experience I have learned that alloys of hardnesses higher than about 500 BHN present serious practical problems in the foundry. Castings made from such alloys are extremely sensitive to thermal shock and may crack or break into pieces even when slowly cooled in the mold. Even if they survive this phase of production, they generally crack and check in the areas where gates and risers have been removed due to the heat generated by metal removal. Alloys of such high hardnesses cannot be welded by ordinary means, so that weld repair of cracks and checks is almost impossible.

While many alloys of hardnesses less than about 400 BHN do not present extreme difficulties in the foundry, others may be quite brittle and sensitive to thermal or mechanical shock even though they may have lower hardnesses. I have found that alloys of greater than about 4.5% carbon content fall into this category. Also in this group are many alloys of high silicon and/or aluminum contents even at carbon levels well below 4%.

At the other end of the hardness range, alloys of less than about 400 BHN usually have hot hardness values below about 200 BHN and have relatively poor abrasion resistance at about 1300° F. (700° C.).

The high carbon Alloys 1, 2 and 3 of Table IV showed increasing hardness when chromium was increased. While chromium is an element which tends to promote the ferritic, or BCC, matrix structure, it also reduces the temperature of transformation as well as the rate of transformation in cooling from high temperature austenitic, or FCC, structure to the low temperature BCC structure.

Alloy 4 in Table IV is an example of how a high silicon content in high carbon alloys tends to result in a sudden large increase in hardness. However, this alloy was extremely brittle. On the other hand, Alloy 8 has an even higher silicon content than Alloy 4 but a lower carbon and chromium content and a higher Ni content. While this alloy contains more silicon than Alloy 4, it is much softer and too expensive due to its high nickel content.

Alloys 5, 6 and 7 are similar to alloys of the invention but lack molybdenum and aluminum. Even though Alloy 7 has good room temperature hardness at the 3.51% C. level, it is of a type which does not retain hot temperature hardness nearly as well as alloys of the invention.

Alloys 20 and 21 are also similar to alloys of the invention but o' lower chromium levels, lack molybdenum aluminum, and have too high of a silicon content. While silicon, chromium and aluminum all promote scale resistance in hot corrosive gases, these high silicon alloys proved to be too soft or too brittle for the intended service. On the other hand, Alloy 1558 was not too brittle but lacked hardness. Alloy 9 is a high carbon version of the same alloy but is excessively brittle.

A high aluminum, Alloy 14, had good hardness but was excessively brittle. As aluminum content was successively reduced in Alloys 14, 15, 16 and 17, the brittleness was finally removed, but hardness was also reduced.

Alloy 18 is similar to alloys of the invention but lacking molybdenum. Alloy 19 shows the effect of increasing carbon and aluminum and lowering nickel in an alloy similar to Alloy 18 to increase hardness. However though the hardness went very high, the alloy was very brittle.

Alloy 10 is similar to alloys of the invention but low in carbon and lacks aluminum and copper. It had insufficient hardness for applications in which the instant alloys are particularly useful. Alloy 24 is also similar to alloys of the invention but is low in molybdenum and lacks aluminum. While it has fair room temperature hardness, it is like Alloy 7 in lacking ability to retain good hardness at 1300° F. (700° C.).

Alloys 12 and 13 are similar to alloys of the invention except that they lack aluminum. While the presence of aluminum in the alloys of the invention does not result in greatly increased room temperature hardness as compared to Alloys 12 and 13, those alloys have increased hot hardness as well as scale resistance.

EXAMPLE 2

One hundred pound heats of several different alloys, as well as one full scale production heat, No. 25P, were prepared in accordance with the invention. Chemical analyses of these alloys as well as their hardnesses at room temperature and at 1300° F. (700° C.) are set forth in Table V. Iron and impurities made up the balance of the alloy compositions but are not stated. As is evident from the data in Table V, alloys of the invention show good consistent hardness values.

TABLE V

| NO. | C | SI | NI | CR | MO | N | MN | CU | AL | RT | 1300° F. |
|---|---|---|---|---|---|---|---|---|---|---|---|
| 22 | 3.15 | 2.44 | 4.85 | 11.66 | 2.51 | 0.00 | 3.58 | — | 0.82 | 410 | 250 |
| 23* | 3.75 | 1.21 | 5.43 | 13.32 | 2.55 | 0.08 | 1.25 | — | 0.78 | 444 | 250 |
| 25CU | 3.73 | 1.05 | 5.02 | 13.73 | 2.21 | 0.13 | 1.11 | 3.52 | 0.66 | 460 | 260 |
| 25L | 3.5 | 1.41 | 8.60 | 15.00 | 2.65 | 0.06 | 1.30 | — | 0.80 | 444 | 240 |
| 25A | 3.0 | 1.41 | 7.25 | 12.85 | 2.30 | 0.09 | 1.80 | — | 0.52 | 444 | 230 |
| 25B | 4.0 | 1.46 | 10.45 | 11.00 | 2.65 | 0.08 | 1.72 | — | 1.08 | 444 | 250 |
| 25P | 3.7 | 1.44 | 6.25 | 15.30 | 2.05 | 0.11 | 1.42 | — | 0.44 | 477 | 270 |

*No. 23 also contains 3.17% Co.

Cement cooler grates were poured from Alloy 25P and from each of the small heats. These grates were rigidly clamped in a fixture by T-bolts engaged in their foot members in a manner employed in actual service. The nuts were then tightened on the bolts to the point at which the bolt threads were actually stripped without breaking the cooler grates themselves. Although brittleness diminishes somewhat at the red heat of operating temperatures, when cooler grates are produced from alloys that are too brittle at room temperature, their mounting feet sheer off readily when the mounting T-bolts are fully tightened.

EXAMPLE 3

Carbides are magnetic but do not comprise a major volume portion of alloys and, therefore, their presence in alloys does not result in very high ferromagnetism in the gross alloy. Austenite and sigma phase, on the other hand, are both nonmagnetic and comprise the major volume portions of the alloys of the invention. Furthermore, ferrite and martensite are both strongly magnetic matrix components and are desirably held to low volume proportions in alloys of the invention. Therefore, the bulk volume of alloys of the invention should have moderately low magnetic permeability values, on the order of 1.05 to 1.4, at or near room temperature. Magnetic permeability values at room temperature either higher or extremely lower than those values indicates that the alloys do not have the desired structure. Accordingly, the alloys of the invention set forth in Table V were tested at room temperature for magnetic permeability using a Severn gage. The results of the permeability tests are set forth in Table VI. While Alloy 24, not of the invention (see Table IV), shows good magnetic properties, it has insufficient hardness (see Table III).

TABLE VI

| ALLOY NUMBER | MAGNETIC PERMEABILITY RANGE |
|---|---|
| 22 | 1.05-1.1 |
| 23 | 1.2-1.4 |
| 25CU | 1.2-1.4 |
| 25L | 1.2-1.4 |
| 25A | 1.02-1.05 |
| 25B | 1.02-1.05 |
| 25P | 1.2-1.4 |

TABLE VI-continued

| ALLOY NUMBER | MAGNETIC PERMEABILITY RANGE |
|---|---|
| 24 | 1.15-1.4 |

While Alloys 22, 25A and 25B are alloys of the invention they have carbon or chromium contents below the preferred ranges. Thus even though those alloys developed adequate hardnesses, higher chromium levels are preferred for scale resistance and higher carbon contents increase abrasion resistance even at the same hardness level. See for example, the hardness data for Alloy 25CU or Alloy 25P in Table V.

The foregoing description of the several embodiments of the invention is not intended as limiting of the invention. As will be apparent to those skilled in the art variations and modifications of the invention may be made without departure from the spirit and scope of this invention.

What is claimed is:

1. A heat and abrasion resistant alloy having high temperature hardness, consisting essentially of:

| | |
|---|---|
| CHROMIUM | 11-20% BY WEIGHT |
| NICKEL | 3-10.5% |
| MOLYBDENUM | 1-4% |
| ALUMINUM | 0.25%-1.5% |
| CARBON | 2-4.5% |
| NITROGEN | UP TO 0.25% |
| SILICON | UP TO 2.5% |
| COPPER | UP TO 4% |
| COBALT | UP TO 4% |
| MANGANESE | UP TO 4% |
| COPPER + COBALT | UP TO 4% TOTAL |
| COPPER + COBALT + MANGANESE | UP TO 5% TOTAL |
| IRON & IMPURITIES BALANCE | ESSENTIALLY |
| provided that NICKEL + COPPER + | 6 TO 11.5% |
| COBALT is | 6 TO 12.5% |
| and further provided that NICKEL + COPPER + COBALT + MANGANESE is | |

2. An alloy of claim 1 wherein:

| | |
|---|---|
| CHROMIUM | 11-18% BY WEIGHT |
| NICKEL | 6-10.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 1.5% |
| IRON | ESSENTIALLY BALANCE |

3. An alloy of claim 1, wherein:

| | |
|---|---|
| CHROMIUM | 13-18% BY WEIGHT |
| NICKEL | 3-10.5% |
| COBALT | UP TO 4% |
| NICKEL + COBALT | 6-11.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 1.5% |
| IRON | ESSENTIALLY BALANCE |

4. An alloy of claim 1, wherein:

| | |
|---|---|
| CHROMIUM | 13-18% BY WEIGHT |
| NICKEL | 3-10.5% |
| COPPER | UP TO 4% |
| NICKEL + COPPER | 6-11.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 1.5% |
| IRON | ESSENTIALLY BALANCE |

5. An alloy of claim 1, wherein:

| | |
|---|---|
| CHROMIUM | 13-18% BY WEIGHT |
| NICKEL | 3-10.5% |
| COBALT | LESS THAN 4% |
| COPPER | LESS THAN 4% |
| COBALT + COPPER | UP TO 4% |
| NICKEL + COBALT + COPPER | 6-11.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 1.5% |
| IRON | ESSENTIALLY BALANCE |

6. An alloy of claim 1, wherein:

| | |
|---|---|
| CHROMIUM | 13-18% BY WEIGHT |
| NICKEL | 3-10.5% |
| MOLYBDENUM | 2-4% |
| ALUMINUM | 0.4-1.2% |
| CARBON | 3-4% |
| NITROGEN | UP TO 0.25% |
| SILICON | UP TO 1.5% |
| MANGANESE | UP TO 4% |
| NICKEL + MANGANESE | 7-12.5% |
| IRON | ESSENTIALLY BALANCE |

7. An alloy of claim 1, wherein:

| | |
|---|---|
| CHROMIUM | 13-18% BY WEIGHT |
| NICKEL | 3-10.5% |
| MOLYBDENUM | 2 TO 4% |
| CARBON | 3-4% |
| NITROGEN | UP TO 0.25% |
| SILICON | UP TO 1.5% |
| COPPER | LESS THAN 4% |
| COBALT | LESS THAN 4% |
| MANGANESE | UP TO 4% |
| NICKEL + COPPER + COBALT | 6-11.5% |
| NICKEL + COPPER + COBALT + MANGANESE | 6-12.5% |
| IRON | ESSENTIALLY BALANCE |

8. An alloy of claim 4 wherein:

| | |
|---|---|
| CHROMIUM | 13.7 BY WEIGHT |
| NICKEL | 5.0 |
| MOLYBDENUM | 2.2 |
| ALUMINUM | 0.7 |
| CARBON | 3.7 |
| NITROGEN | UP TO 0.25% |
| SILICON | 1.0 |
| COPPER | 3.5 |
| MANGANESE | 1.1 |
| IRON | ESSENTIALLY BALANCE |

9. An alloy of claim 2 wherein:

| | |
|---|---|
| CHROMIUM | 12.8 BY WEIGHT |
| NICKEL | 7.2 |
| MOLYBDENUM | 2.0 |
| ALUMINUM | 0.4 |
| CARBON | 3.7 |
| NITROGEN | UP TO 0.25% |
| SILICON | 1.4 |
| MANGANESE | 1.4 |
| IRON | ESSENTIALLY BALANCE |

10. An alloy of claim 3 wherein:

| | |
|---|---|
| CHROMIUM | 13.3 BY WEIGHT |
| NICKEL | 5.4 |
| COBALT | 3.2 |
| MOLYBDENUM | 2.5 |
| ALUMINUM | 0.8 |
| CARBON | 3.7 |
| NITROGEN | UP TO 0.25% |
| SILICON | 1.2 |
| MANGANESE | 1.2 |
| IRON | ESSENTIALLY BALANCE |

* * * * *